US012252364B2

(12) United States Patent
Hatada

(10) Patent No.: US 12,252,364 B2
(45) Date of Patent: Mar. 18, 2025

(54) PRINTING APPARATUS AND CONVEYANCE CONTROL METHOD

(71) Applicant: SEIKO EPSON CORPORATION, Tokyo (JP)

(72) Inventor: Kenji Hatada, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 210 days.

(21) Appl. No.: 18/171,212

(22) Filed: Feb. 17, 2023

(65) Prior Publication Data

US 2023/0264916 A1 Aug. 24, 2023

(30) Foreign Application Priority Data

Feb. 21, 2022 (JP) ..... 2022-024531

(51) Int. Cl.
*B65H 23/18* (2006.01)
*B65H 20/02* (2006.01)
*B65H 23/188* (2006.01)

(52) U.S. Cl.
CPC ..... *B65H 23/188* (2013.01); *B65H 20/02* (2013.01); *B65H 2513/11* (2013.01); *B65H 2801/21* (2013.01)

(58) Field of Classification Search
CPC ..... B65H 20/02; B65H 23/18; B65H 23/188; B65H 23/192; B65H 23/1888; B65H 2513/11; B65H 2553/51; B65H 2801/12; B65H 2801/21
USPC ..... 270/52.08
See application file for complete search history.

(56) References Cited

U.S. PATENT DOCUMENTS 10,350,918 B2 * 7/2019 Akahane ..... B41J 13/0027
11,225,096 B2 * 1/2022 Yokozawa ..... B41J 13/03

FOREIGN PATENT DOCUMENTS

CN 106458486 B * 4/2018 ..... B65H 16/06
CN 110654918 A * 1/2020 ..... B65H 23/044
JP 2020-158292 A 10/2020

* cited by examiner

*Primary Examiner* — Leslie A Nicholson, III
(74) *Attorney, Agent, or Firm* — WORKMAN NYDEGGER

(57) ABSTRACT

A printing apparatus includes a conveyance unit, a printing unit, and a control unit. The conveyance unit includes a feeding unit, a conveyance roller pair, a feed driving unit, a first encoder, and a second encoder. The control unit is configured to execute a feed adjustment operation of adjusting tension of the medium fed from the feeding unit by controlling the feed driving unit such that the control unit executes the feed adjustment operation based on an output of the second encoder in a first period from a start of rotation of the conveyance roller pair until a specified time elapses and such that the control unit executes the feed adjustment operation based on an output of the first encoder in a second period after completion of the first period.

6 Claims, 3 Drawing Sheets

PRINTING APPARATUS AND CONVEYANCE CONTROL METHOD

The present application is based on, and claims priority from JP Application Serial Number 2022-024531, filed Feb. 21, 2022, the disclosure of which is hereby incorporated by reference herein in its entirety.

BACKGROUND

1. Technical Field

The present disclosure relates to a printing apparatus and a conveyance control method.

2. Related Art

A printing apparatus disclosed in JP-A-2020-158292 includes a conveyance unit that conveys a medium, and a printing unit that performs printing on the medium conveyed by the conveyance unit. The conveyance unit includes a feeding unit that feeds the medium from a roll composed of the medium in a rolled form, a conveyance roller pair that conveys, toward the printing unit, the medium fed by the feeding unit, and a feed driving unit that drives the feeding unit into rotation.

At the start of the conveyance of the medium, the medium located between the conveyance roller pair and the feeding unit is pulled toward the conveyance roller pair along with the rotation of the conveyance roller pair. Consequently, when the roll is rotated at a rotational speed faster than the rotational speed of the feed driving unit, a difference in rotational speed is caused between the feed driving unit and the roll. In the case where a control of feeding the medium from the feeding unit is performed based on the rotational speed of the feed driving unit, the accuracy of the control may be reduced due to the above-described difference in rotational speed.

SUMMARY

A printing apparatus for solving the above-described problems includes a conveyance unit configured to convey a medium, a printing unit configured to perform printing on the medium conveyed by the conveyance unit, and a control unit configured to control the conveyance unit, wherein the conveyance unit includes a feeding unit configured to feed the medium from a roll wound with the medium in a rolled form, a conveyance roller pair configured to convey, toward the printing unit, the medium fed by the feeding unit while sandwiching the medium, a feed driving unit configured to drive the feeding unit into rotation, a first encoder configured to detect a rotational speed of the feed driving unit, and a second encoder configured to detect a rotational speed of the feeding unit and the control unit is configured to execute a feed adjustment operation of adjusting tension of the medium fed from the feeding unit by controlling the feed driving unit such that the control unit executes the feed adjustment operation based on an output of the second encoder in a first period from a start of rotation of the conveyance roller pair until a specified time elapses and such that the control unit executes the feed adjustment operation based on an output of the first encoder in a second period after completion of the first period.

A conveyance control method for solving the above-described problems is a conveyance control method of conveying a medium by a conveyance unit, the conveyance unit including a feeding unit configured to feed the medium from a roll wound with the medium in a rolled form, a conveyance roller pair configured to convey the medium fed by the feeding unit while sandwiching the medium, a feed driving unit configured to drive the feeding unit into rotation, a first encoder configured to detect a rotational speed of the feed driving unit, and a second encoder configured to detect a rotational speed of the feeding unit, the conveyance control method including executing a feed adjustment operation of adjusting tension of the medium fed from the feeding unit by controlling the feed driving unit such that the feed adjustment operation is executed based on an output of the second encoder in a first period from a start of rotation of the conveyance roller pair until a specified time elapses and such that the feed adjustment operation is executed based on an output of the first encoder in a second period after completion of the first period.

DESCRIPTION OF EXEMPLARY EMBODIMENTS

Figure 1:
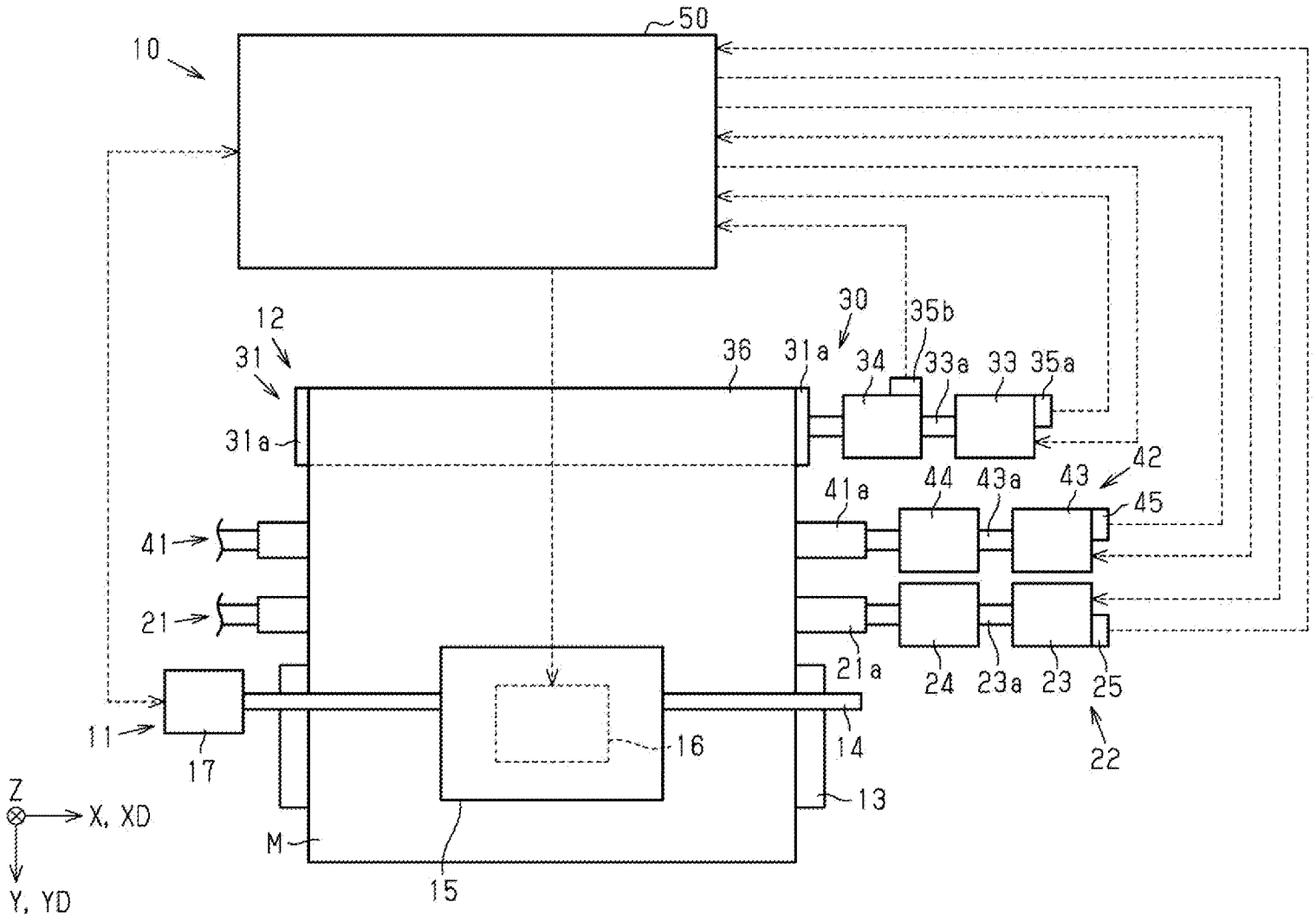
FIG. 1 is a schematic view illustrating a printing apparatus according to an embodiment.

A printing apparatus and a conveyance control method according to an embodiment are described below with reference to the accompanying drawings. The printing apparatus is an ink-jet printer that performs printing by ejecting ink, which is an example of liquid, to a medium such as a sheet, fabric, vinyl, a plastic material, and a metal material, for example. The printing apparatus is a large format printer, for example. The large format printer is a printer that can perform printing on a medium with a size of A3-short width (297 mm) or larger.

In the drawing, the gravity direction is indicated as the Z axis, and the direction along the horizontal plane is indicated as the X axis and the Y axis on the assumption that the printing apparatus is placed on a horizontal plane. The X axis, the Y axis, and the Z axis are orthogonal to each other. The direction parallel to the X axis is also referred to as width direction X.

Printing Apparatus

As illustrated in FIG. 1, a printing apparatus 10 includes a conveyance unit 12 that conveys a medium M, and a printing unit 11 that performs printing on the medium M conveyed by the conveyance unit 12. The printing apparatus 10 may alternately perform the printing operation of the printing unit 11 and the conveyance operation of the conveyance unit 12. The printing apparatus 10 may include a support base 13. The support base 13 extends in the width direction X. The support base 13 supports the medium M in a printing region where printing is performed on the medium M by the printing unit 11.

The printing unit 11 may include a guide shaft 14, a carriage 15, a printing head 16, and a carriage driving mechanism 17. The guide shaft 14 extends in the width direction X on the upper side of the support base 13. The guide shaft 14 supports the carriage 15 so as to allow for movement along the guide shaft 14.

The printing head 16 is mounted in the carriage 15. The printing head 16 performs printing on the medium M by ejecting liquid to the medium M supported by the support base 13. The carriage driving mechanism 17 is a mechanism that moves the carriage 15 in a scanning direction XD. The printing unit 11 performs printing operation by ejecting liquid from the printing head 16 while moving the carriage 15 in the scanning direction XD along the guide shaft 14 with the carriage driving mechanism 17. The scanning direction XD may be parallel to the X axis direction. As described above, the printing unit 11 is of a serial type, but may be of a line type, for example.

Conveyance Roller Pair

Figure 2:
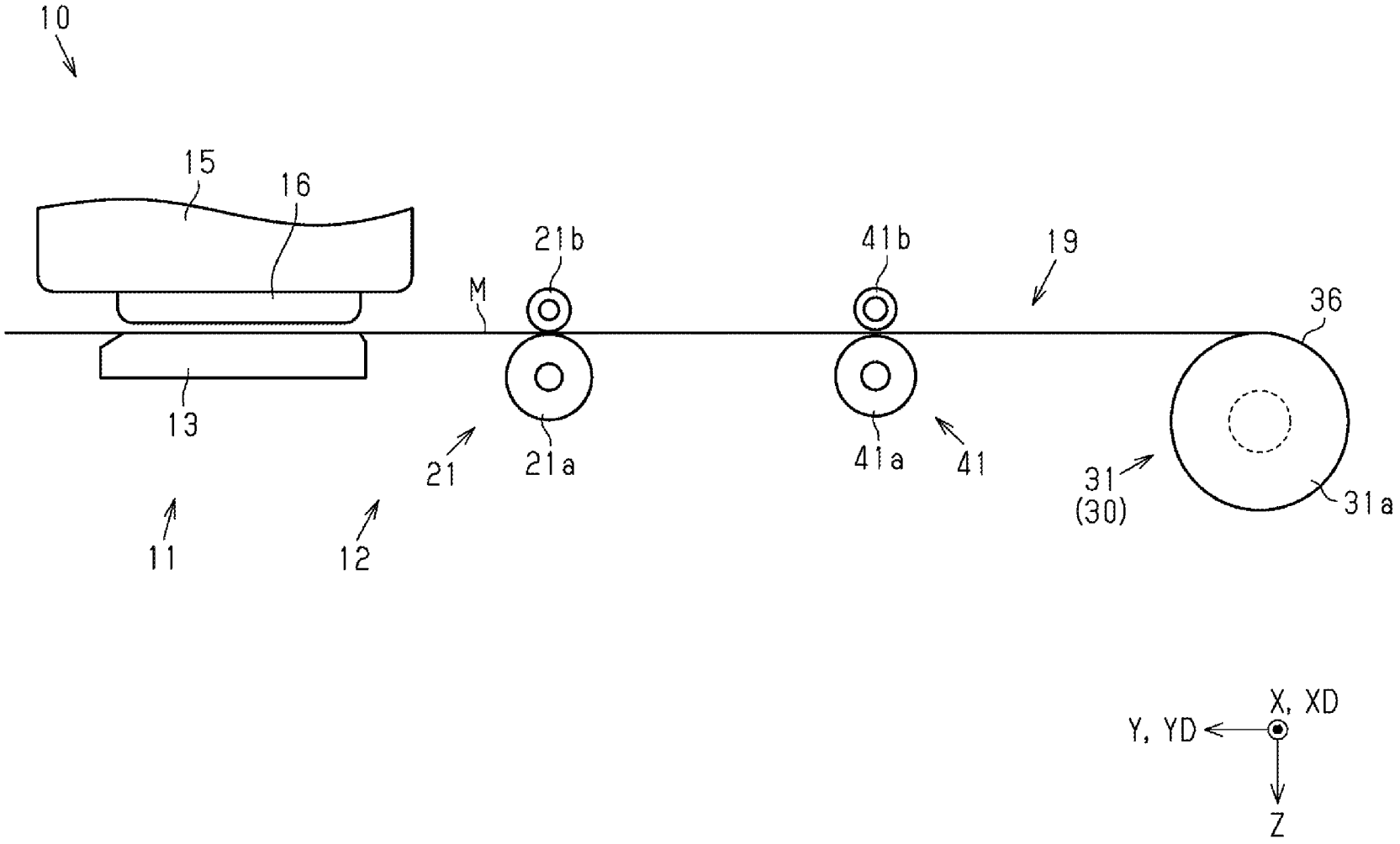
FIG. 2 is a schematic view illustrating a positional relationship among a roll, an intermediate roller pair, a conveyance roller pair, and a printing head.

As illustrated in FIG. 2, the conveyance unit 12 includes a conveyance roller pair 21 that conveys the medium M toward the printing unit 11 while sandwiching the medium M. The conveyance roller pair 21 includes a first driving roller 21*a* and a first driven roller 21*b*. The first driven roller 21*b* sandwiches the medium M together with the first driving roller 21*a*.

The first driven roller 21*b* rotates along with the rotation of the first driving roller 21*a*. The conveyance roller pair 21 is a nip roller. Each of the first driving roller 21*a* and the first driven roller 21*b* can rotate around the rotation shaft extending in the width direction X. Each of the first driving roller 21*a* and the first driven roller 21*b* may have a columnar shape extending in the width direction X.

First Driving Unit

As illustrated in FIG. 1, the conveyance unit 12 may include a first driving unit 22 that rotates the first driving roller 21*a*. When the first driving unit 22 drives the first driving roller 21*a* into rotation, the conveyance roller pair 21 conveys the medium M in a conveyance direction YD. The conveyance direction YD is the longitudinal direction of the medium M. The conveyance direction YD may be a direction parallel to the Y axis.

The first driving unit 22 may include a conveyance driving unit 23, a conveyance transmission mechanism 24, and a conveyance rotation detection unit 25. The conveyance driving unit 23 is a DC motor, for example. The conveyance driving unit 23 generates a conveyance driving torque for driving the first driving roller 21*a* into rotation.

The conveyance transmission mechanism 24 transmits, to the first driving roller 21*a*, the conveyance driving torque generated by the conveyance driving unit 23 at a predetermined reduction ratio. The first driving roller 21*a* rotates when the conveyance driving torque is transmitted from the conveyance transmission mechanism 24.

When the conveyance driving unit 23 is driven into forward rotation, the conveyance roller pair 21 rotates in the forward rotation direction. By rotating in the forward rotation direction, the conveyance roller pair 21 can convey the medium M in the conveyance direction YD toward the support base 13. The printing unit 11 performs printing on the medium M sent out from the conveyance roller pair 21. When the conveyance driving unit 23 is driven into reverse rotation, the conveyance roller pair 21 rotates in the reverse rotation direction. By rotating in the reverse rotation direction, the conveyance roller pair 21 can convey the medium M in the direction opposite to the conveyance direction YD.

The conveyance rotation detection unit 25 detects the rotational position and rotational direction of a conveyance output shaft 23*a*, which is an output shaft of the conveyance driving unit 23. The conveyance rotation detection unit 25 is a rotary encoder composed of a photo-interrupter and a scale with a disk shape provided at the conveyance output shaft 23*a* of the conveyance driving unit 23, for example.

Feeding Unit

As illustrated in FIG. 2, the conveyance unit 12 includes a feeding unit 30 that feeds the medium M from a roll 36. The roll 36 is wound with the medium M in a rolled form. The feeding unit 30 is disposed upstream of the conveyance roller pair 21 in the conveyance direction YD in a conveyance path 19 of the medium M.

As illustrated in FIG. 1, the feeding unit 30 may include a supporting unit 31 that supports the roll 36. The supporting unit 31 supports the roll 36 in a rotatable manner. The supporting unit 31 may include a holder 31*a* that holds an end portion of the roll 36. The holder 31*a* may be located one at both end portions of the roll 36 in the width direction X.

The feeding unit 30 may include a power transmission mechanism 34. The power transmission mechanism 34 may include a plurality of gears engaged with each other. The power transmission mechanism 34 may transmit the rotary power to the holder 31*a* through the rotation of the plurality of gears engaged with each other. The power transmission mechanism 34 transmits a roll driving torque to the holder 31*a*. When the roll driving torque is transmitted from the power transmission mechanism 34, the holder 31*a* rotates. Along with the rotation of the holder 31*a*, the roll 36 rotates.

Feed Driving Unit

The conveyance unit 12 may include a feed driving unit 33. The feed driving unit 33 is a DC motor, for example. The feed driving unit 33 generates a roll driving torque for driving the roll 36 into rotation. The feed driving unit 33 drives the feeding unit 30 into rotation. Specifically, the feed driving unit 33 drives the supporting unit 31 into rotation.

Transmission of Rotary Power from Feed Driving Unit to Supporting Unit

The power transmission mechanism 34 transmits the rotary power of the feed driving unit 33 to the supporting unit 31. The power transmission mechanism 34 may transmit, to the supporting unit 31, the roll driving torque generated by the feed driving unit 33 at a predetermined reduction ratio. One of the plurality of gears of the power transmission mechanism 34 may be coupled with a feed output shaft 33*a*, which is an output shaft of the feed driving unit 33, and another one of the plurality of gears may be coupled with the supporting unit 31. Through the rotation of the plurality of gears of the power transmission mechanism 34 engaged with each other, the rotary power may be transmitted from the gear coupled with the feed output shaft 33*a* to the gear coupled with the supporting unit 31.

When the feed driving unit 33 is driven into forward rotation, the supporting unit 31 rotates in the forward rotation direction. By rotating in the forward rotation direction, the supporting unit 31 can feed the medium M from the roll 36 toward the conveyance roller pair 21. The conveyance roller pair 21 conveys, toward the printing unit 11, the medium M fed by the feeding unit 30 while sandwiching the medium M. When the feed driving unit 33 is driven into reverse rotation, the supporting unit 31 rotates in the reverse rotation direction. By rotating in the reverse rotation direction, the supporting unit 31 can wind up the medium M around the roll 36.

First Encoder

The conveyance unit 12 includes a first encoder 35*a*. The first encoder 35*a* detects the rotational speed of the feed driving unit 33. The rotational speed of the feed driving unit 33 detected by the first encoder 35*a* is referred to also as driving rotational speed SP1.

The first encoder 35*a* may detect the rotational speed of the feed driving unit 33 by detecting the rotational position and rotational direction of the feed output shaft 33*a* of the feed driving unit 33. The first encoder 35*a* is a rotary encoder composed of a photo-interrupter and a scale with a disk shape provided at the feed output shaft 33*a* of the feed driving unit 33, for example.

Second Encoder

The conveyance unit 12 includes a second encoder 35*b*. The second encoder 35*b* detects the rotational speed of the feeding unit 30. The rotational speed of the feeding unit 30 detected by the second encoder 35*b* is referred to also as feeding rotational speed SP2. The second encoder 35*b* detects the rotational speed of the power transmission mechanism 34. The feeding rotational speed SP2 in this embodiment is the rotational speed of the power transmission mechanism 34.

The second encoder 35*b* may detect the feeding rotational speed SP2 by detecting the rotational position and rotational direction of the rotation shaft of one gear making up the power transmission mechanism 34. The second encoder 35*b* is a rotary encoder composed of a photo-interrupter and a scale with a disk shape provided at the rotation shaft of the gear in the power transmission mechanism 34, for example.

Intermediate Roller Pair

As illustrated in FIG. 2, the conveyance unit 12 may include an intermediate roller pair 41. The intermediate roller pair 41 conveys, toward the conveyance roller pair 21, the medium M fed by the feeding unit 30 while sandwiching the medium M at a position between the feeding unit 30 and the conveyance roller pair 21.

The intermediate roller pair 41 includes a second driving roller 41*a* and a second driven roller 41*b*. The second driven roller 41*b* sandwiches the medium M together with the second driving roller 41*a*. The second driven roller 41*b* rotates along with the rotation of the second driving roller 41*a*. The intermediate roller pair 41 is a nip roller. Each of the second driving roller 41*a* and the second driven roller 41*b* can rotate around the rotation shaft extending in the width direction X. Each of the second driving roller 41*a* and the second driven roller 41*b* may have a columnar shape extending in the width direction X.

Second Driving Unit

As illustrated in FIG. 1, the conveyance unit 12 may include a second driving unit 42 that drives the second driving roller 41*a*. When the second driving unit 42 drives the second driving roller 41*a* into rotation, the intermediate roller pair 41 conveys the medium M in the conveyance direction YD.

The second driving unit 42 may include an intermediate driving unit 43 that rotates the intermediate roller pair 41. Specifically, the conveyance unit 12 may include the intermediate driving unit 43. The intermediate driving unit 43 is a DC motor, for example. The intermediate driving unit 43 generates an intermediate driving torque that drives the intermediate roller pair 41.

The second driving unit 42 may include an intermediate transmission mechanism 44. The intermediate transmission mechanism 44 transmits, to the second driving roller 41*a*, the intermediate driving torque generated by the intermediate driving unit 43 at a predetermined reduction ratio. The second driving roller 41*a* rotates when the conveyance driving torque is transmitted from the intermediate transmission mechanism 44.

When the intermediate driving unit 43 is driven into forward rotation, the intermediate roller pair 41 rotates in the forward rotation direction. By rotating in the forward rotation direction, the intermediate roller pair 41 can convey, toward the conveyance roller pair 21, the medium M in the conveyance direction YD. When the intermediate driving unit 43 is driven into reverse rotation, the intermediate roller pair 41 rotates in the reverse rotation direction. By rotating in the reverse rotation direction, the intermediate roller pair 41 can convey, toward the roll 36, the medium M in the direction opposite to the conveyance direction YD.

The second driving unit 42 may include an intermediate rotation detection unit 45. The intermediate rotation detection unit 45 detects the rotational position and rotational direction of an intermediate output shaft 43*a*, which is an output shaft of the intermediate driving unit 43. The intermediate rotation detection unit 45 is a rotary encoder composed of a photo-interrupter and a scale with a disk shape provided at the intermediate output shaft 43*a* of the intermediate driving unit 43, for example.

Control Unit

Figure 3:
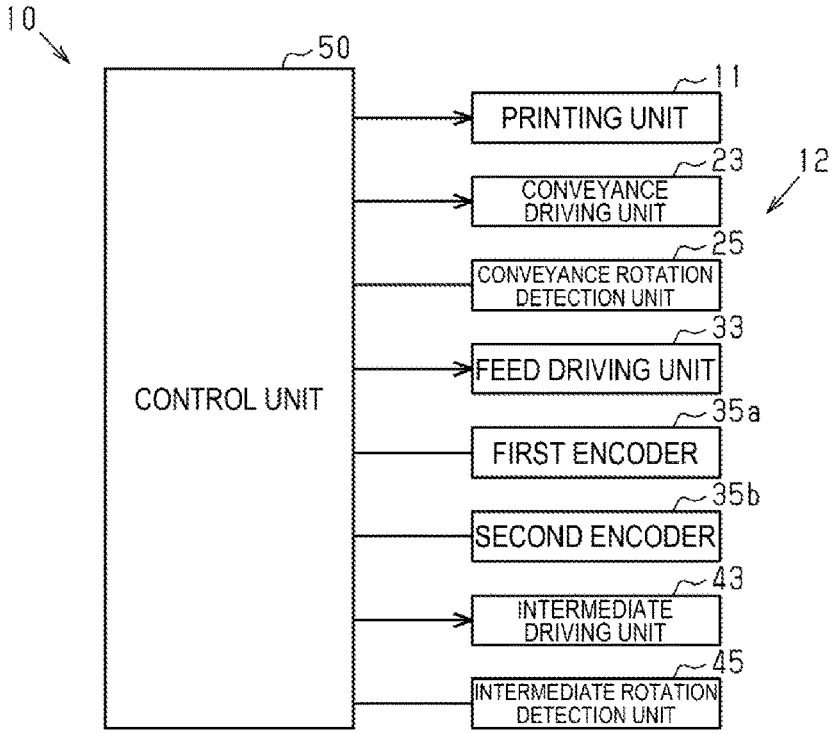
FIG. 3 is a block diagram illustrating an electrical configuration of the printing apparatus.

As illustrated in FIG. 3, the printing apparatus 10 includes a control unit 50. The control unit 50 controls various operations executed in the printing apparatus 10. The control unit 50 may be electrically coupled to the printing unit 11. The control unit 50 may control the printing unit 11. The control unit 50 controls the conveyance unit 12.

The control unit 50 may be configured as a circuit including (α) one or more processors that execute various processes in accordance with a computer program, (β) one or more dedicated hardware circuits that execute at least some of various processes, or (γ) a combination of them. The hardware circuit is an application-specific integrated circuit, for example. The processor includes a CPU and a memory such as a RAM and a ROM, and the memory stores a program code or a command configured to cause the CPU to execute processing. The memory, i.e., a computer readable medium, includes any readable media that are accessible with general-purpose or dedicated computers.

The control unit 50 may be electrically coupled to the conveyance driving unit 23. The control unit 50 controls the driving of the conveyance driving unit 23. The control unit 50 may drive the conveyance driving unit 23 such that the conveyance roller pair 21 rotates in the forward rotation direction when a printing condition is met. The printing condition may be met when a printing request input in accordance with an operation of an operation unit not illustrated in the drawing. The printing condition may be met when a printing request is input from a terminal apparatus not illustrated in the drawing. When the conveyance roller pair 21 rotates in the forward rotation direction along with the driving of the conveyance driving unit 23, the medium M is conveyed with the conveyance roller pair 21. The control unit 50 may drive the conveyance driving unit 23 such that the conveyance roller pair 21 rotates in the reverse rotation direction. The control unit 50 may control the driving of the conveyance driving unit 23 by controlling the supply of the constant power to the conveyance driving unit 23 through a pulse width modulation (PWM) control.

The control unit 50 may be electrically coupled to the feed driving unit 33. The control unit 50 may control the driving of the feed driving unit 33. The feed driving unit 33 may be driven such that the roll 36 rotates in the forward rotation direction when a printing condition is met. When the roll 36 rotates in the forward rotation direction along with the driving of the feed driving unit 33, the medium M is fed from the roll 36 toward the conveyance roller pair 21. The control unit 50 may drive the feed driving unit 33 such that the roll 36 rotates in the reverse rotation direction. The control unit 50 may control the driving of the feed driving unit 33 by controlling the supply of the constant power to the feed driving unit 33 through a PWM control.

The control unit 50 may be electrically coupled to the intermediate driving unit 43. The control unit 50 may control the driving of the intermediate driving unit 43. The control unit 50 may drive the intermediate driving unit 43 such that the intermediate roller pair 41 rotates in the forward rotation direction when a printing condition is met. When the intermediate roller pair 41 rotates in the forward rotation direction along with the driving of the intermediate driving unit 43, the medium M is conveyed by the intermediate roller pair 41 toward the conveyance roller pair 21. The control unit 50 may drive the intermediate driving unit 43 such that the intermediate roller pair 41 rotates in the reverse rotation direction. The control unit 50 controls the driving of the intermediate driving unit 43 by controlling the supply of the constant power to the intermediate driving unit 43 through a PWM control.

As illustrated in FIG. 1, the control unit 50 conveys the medium M by causing the conveyance unit 12 to repeat intermittent conveyance. The intermittent conveyance is an operation of switching stop of the conveyance of the medium M and conveyance of the medium M at the conveyance unit 12 in a preliminarily set cycle. The control unit 50 controls the conveyance driving unit 23 to perform the rotation and stop of the first driving roller 21*a* in an alternate manner in the intermittent conveyance in which the conveyance and the stop of the conveyance of the medium M are performed in an alternate manner. The control unit 50 causes the printing unit 11 to perform the printing operation when the conveyance of the medium M is stopped in the intermittent conveyance.

During the conveyance of the medium M by the conveyance unit 12, the conveyance driving unit 23 is driven such that the conveyance roller pair 21 rotates in the forward rotation direction. During the conveyance of the medium M by the conveyance unit 12, the feed driving unit 33 is driven such that the roll 36 rotates in the forward rotation direction. During the conveyance of the medium M by the conveyance unit 12, the intermediate driving unit 43 is driven such that the intermediate roller pair 41 rotates in the forward rotation direction. When the conveyance of the medium M by the conveyance unit 12 is stopped, the driving of the conveyance driving unit 23, the feed driving unit 33, and the intermediate driving unit 43 may be stopped.

As illustrated in FIG. 3, the control unit 50 may be electrically coupled to the conveyance rotation detection unit 25. A pulse signal may not be input to the control unit 50 from the conveyance rotation detection unit 25. For example, the control unit 50 acquires the rotational position and rotational direction of the conveyance output shaft 23*a* detected by the conveyance rotation detection unit 25. The control unit 50 acquires the rotational position and rotational speed of the first driving roller 21*a* based on the acquired rotational position and rotational direction of the conveyance output shaft 23*a*. The control unit 50 can execute the feedback control of the first driving roller 21*a* based on the acquired rotational position and rotational speed of the first driving roller 21*a*.

The control unit 50 may be electrically coupled to the first encoder 35*a*. A pulse signal may be input to the control unit 50 from the first encoder 35*a*. For example, the control unit 50 acquires the rotational position and rotational direction of the feed output shaft 33*a* detected by the first encoder 35*a*. The control unit 50 acquires the rotational speed of the feed output shaft 33*a* based on the acquired rotational position and rotational direction of the feed output shaft 33*a*. That is, it can be said that the first encoder 35*a* detects the driving rotational speed SP1, which is the rotational speed of the feed driving unit 33. The control unit 50 can execute the feedback control of the feeding unit 30 based on the driving rotational speed SP1 and the rotational position of the acquired feed driving unit 33.

The control unit 50 may be electrically coupled to the second encoder 35*b*. A pulse signal may be input to the control unit 50 from the second encoder 35*b*. For example, the control unit 50 acquires the rotational position and rotational direction of the power transmission mechanism 34 detected by the second encoder 35*b*. The control unit 50 acquires the rotational speed of the power transmission mechanism 34 based on the acquired rotational position and rotational direction of the power transmission mechanism 34. That is, it can be said that the second encoder 35*b* detects the feeding rotational speed SP2, which is the rotational speed of the feeding unit 30. The control unit 50 can execute the feedback control of the feeding unit 30 based on the feeding rotational speed SP2 and the rotational position of the acquired feeding unit 30.

The control unit 50 may be electrically coupled to the intermediate rotation detection unit 45. A pulse signal may be input to the control unit 50 from the intermediate rotation detection unit 45. For example, the control unit 50 acquires the rotational position and rotational direction of the intermediate output shaft 43*a* detected by the intermediate rotation detection unit 45. The control unit 50 acquires the rotational position and rotational speed of second driving roller 41*a* based on the acquired rotational position and rotational direction of the intermediate output shaft 43*a*. The control unit 50 can execute the feedback control of the second driving roller 41*a* based on the acquired rotational position and rotational speed of the second driving roller 41*a*.

The control unit 50 may execute a position feedback control and a speed feedback control. The position feedback control is a PID control related to the rotational positions of the first driving roller 21*a*, the second driving roller 41*a*, and the holder 31*a*. The speed feedback control is a PID control related to the rotational speeds of the first driving roller 21*a*, the second driving roller 41*a*, and the holder 31*a*. When a target value of the rotational speed is input to the control unit 50, the control unit 50 executes the position feedback control. When a target value of the rotational speed of the first driving roller 21*a* is input to the control unit 50, the control unit 50 executes the speed feedback control. Note that the feedback control may be performed through a PI control.

Intermediate Adjustment Operation

As illustrated in FIG. 1, the control unit 50 may be able to execute an intermediate adjustment operation M1. In the intermediate adjustment operation M1, the control unit 50 adjusts tension T of the medium M located between the conveyance roller pair 21 and the intermediate roller pair 41. The control unit 50 can execute the intermediate adjustment operation M1 by controlling the intermediate driving unit 43. In the intermediate adjustment operation M1, the control unit 50 may adjust the tension T of the medium M located between the conveyance roller pair 21 and the intermediate roller pair 41 to first target tension Ta.

Feed Adjustment Operation

The control unit 50 can execute a feed adjustment operation M2. In the feed adjustment operation M2, the control unit 50 adjusts the tension T of the medium M fed from the feeding unit 30. The control unit 50 can execute the feed adjustment operation M2 by controlling the feed driving unit 33. The control unit 50 may execute the feed adjustment operation M2 by adjusting the tension T of the medium M located between the intermediate roller pair 41 and the feeding unit 30. In the feed adjustment operation M2, the control unit 50 may adjust the tension T of the medium M located between the intermediate roller pair 41 and the feeding unit 30 to second target tension Tb.

Load Acquisition Operation and Reference Current Acquisition Operation

The control unit 50 may perform a load acquisition operation M3 and a reference current acquisition operation M4. The control unit 50 may perform the intermediate adjustment operation M1 and the feed adjustment operation M2 based on information obtained through the load acquisition operation M3 and the reference current acquisition operation M4.

In the load acquisition operation M3, the control unit 50 can acquire an intermediate roller load N1 for a given rotational speed of the second driving roller 41*a*. It has been determined that the intermediate roller load N1 is in a linear relationship with the rotational speed of the second driving roller 41*a* from a result of an experiment and/or a simulation performed in advance. When mounting the roll 36 to the printing apparatus 10, the control unit 50 executes the load acquisition operation M3 that enables computation of the intermediate roller load N1 for a given rotational speed of the second driving roller 41*a*.

The load acquisition operation M3 may use an output result from the intermediate rotation detection unit 45 as the rotational speed of the second driving roller 41*a*. The intermediate roller load N1 may be computed based on an output of the intermediate rotation detection unit 45. The computation of the intermediate roller load N1 may be repeatedly computed in a predetermined cycle.

In the load acquisition operation M3, the control unit 50 can acquire a roll load N2 for a given rotational speed of the roll 36. It has been determined that the roll load N2 is in a linear relationship with the rotational speed of the roll 36 from a result of an experiment and/or a simulation performed in advance. When mounting the roll 36 to the printing apparatus 10, the control unit 50 executes the load acquisition operation M3 that enables computation of the roll load N2 for a given rotational speed of the roll 36.

The load acquisition operation M3 may use the output result from the first encoder 35*a* and the output result from the second encoder 35*b* in a switching manner as the rotational speed of the roll 36. In the case where the output result from the first encoder 35*a* is used as the rotational speed of the roll 36, the roll load N2 may be computed based on the output of the first encoder 35*a*. In the case where the output result from the first encoder 35*a* is used as the rotational speed of the roll 36, the roll load N2 may be computed based on the output of the first encoder 35*a*. The computation of the roll load N2 may be repeatedly computed in a predetermined cycle.

In the reference current acquisition operation M4, the control unit 50 can acquire the current flowing through the intermediate driving unit 43 when the intermediate driving unit 43 is driven with the same rotational speed and drive time as those of the conveyance of the medium M. In the reference current acquisition operation M4, the control unit 50 can acquire the current flowing through the feed driving unit 33 when the feed driving unit 33 is driven with the same rotational speed and drive time as those of the conveyance of the medium M.

Tension of Medium Between Conveyance Roller Pair and Intermediate Roller Pair

The tension T of the medium M located between the conveyance roller pair 21 and the intermediate roller pair 41 is described below. First, the following describes first tension T1, which is the tension T acting on the medium M located between the conveyance roller pair 21 and the intermediate roller pair 41 in the case where the medium M of the state of being supported by the conveyance roller pair 21 and the intermediate roller pair 41 is conveyed with the conveyance roller pair 21 alone.

In the case where the medium M of the state of being supported by the conveyance roller pair 21 and the intermediate roller pair 41 is conveyed with the conveyance roller pair 21 alone, the medium M is pulled by the first driving roller 21*a*. As a result, the second driving roller 41*a* rotates in a driven manner in the forward rotation direction. The intermediate roller load N1, which is a load required for rotating the intermediate roller pair 41, is generated at the intermediate roller pair 41. At this time, the first tension T1 is expressed by the following Equation (1). Note that a first proportional constant k1 is a constant set based on a result of an experiment and/or a simulation performed in advance. A first radius R1 is a radius of the second driving roller 41*a*.

$$T1=k1\times N1/R1 \tag{1}$$

Next, the first tension T1 of the case where the medium M is sent by using the conveyance roller pair 21 and the intermediate roller pair 41 is described. In this case, a first output torque Tq1 that rotates the second driving roller 41*a* in the forward rotation direction is generated at the second driving roller 41*a*. As a result, a torque obtained by subtracting the first output torque Tq1 from the intermediate roller load N1 is acting on the second driving roller 41*a*. The first tension T1 at this time can be expressed by the following Equation (2).

$$T1=k1\times(N1-Tq1)/R1 \tag{2}$$

From the above-described Equation (1) and Equation (2), the first output torque Tq1 of the second driving roller 41*a* can be expressed by the following Equation (3).

$$Tq1=N1-\{(R1/k1)\times T1\} \tag{3}$$

With the above-described Equation (3), the first proportional constant k1, the first radius R1, which is the radius of the second driving roller 41*a*, and the intermediate roller load N1 become known values. The first target tension Ta is input to the first tension T1 of the above-described Equation (3). In this manner, it is possible to compute the first output torque Tq1 of the second driving roller 41*a* required for generating the first target tension Ta at the medium M located between the conveyance roller pair 21 and the intermediate roller pair 41.

The first target tension Ta is set to a value with which a state where the medium M located between the conveyance roller pair 21 and the intermediate roller pair 41 is not skewed and broken is maintained. The first target tension Ta is set in accordance with the property of the medium M based on a result of an experiment and/or a simulation performed in advance. The set first target tension Ta is stored in the control unit 50 in association with the property of the medium M. Information related to the property of the medium M may be input to the control unit 50 through a user operation at an operation unit not illustrated in the drawing. The control unit 50 may select the first target tension Ta based on the input information related to the property of the medium M.

The control unit 50 may repeatedly perform the computation of the first output torque Tq1 described above in a predetermined cycle. The control unit 50 can execute the intermediate adjustment operation M1 by controlling the intermediate driving unit 43 such that the computed first output torque Tq1 is generated at the second driving roller 41*a*. Since the control unit 50 computes the intermediate roller load N1 based on the output of the intermediate rotation detection unit 45, it can be said that the control unit 50 executes the intermediate adjustment operation M1 based on the output of the intermediate rotation detection unit 45.

Tension of Medium Between Intermediate Roller Pair and Feeding Unit

The tension T of the medium M located between the intermediate roller pair 41 and the feeding unit 30 is described below. First, the following describes second tension T2, which is the tension T acting on the medium M located between the intermediate roller pair 41 and the feeding unit 30 in the case where the medium M of the state of being supported by the intermediate roller pair 41 and the feeding unit 30 is conveyed with the intermediate roller pair 41 alone.

In the case where the medium M of the state of being supported by the intermediate roller pair 41 and the feeding unit 30 is conveyed with the intermediate roller pair 41 alone, the medium M is pulled by the second driving roller 41*a*. As a result, the roll 36 rotates in a driven manner in the forward rotation direction. The roll load N2, which is a load required for rotating the roll 36, is generated at the roll 36. At this time, the second tension T2 is expressed by the following Equation (4). Note that a second proportional constant k2 is a constant set based on a result of an experiment and/or a simulation performed in advance. A second radius R2 is the radius of the roll 36.

$$T2=k2\times N2/R2 \tag{4}$$

Next, the second tension T2 of the case where the medium M is sent by using the intermediate roller pair 41 and the feeding unit 30 is described. In this case, a second output torque Tq2 that rotates the roll 36 in the forward rotation direction is generated at the roll 36. As a result, a torque obtained by subtracting the second output torque Tq2 from the roll load N2 is acting on the roll 36. The second tension T2 at this time can be expressed by the following Equation (5).

$$T2=k2\times(N2-Tq2)/R2 \tag{5}$$

From the above-described Equation (4) and Equation (5), the second output torque Tq2 of the roll 36 can be expressed by the following Equation (6).

$$Tq2=N2-\{(R2/k2)\times T2\} \tag{6}$$

With the above-described Equation (6), the second proportional constant k2, the second radius R2, which is the radius of the roll 36, and the roll load N2 become known values. It is possible to compute the second output torque Tq2 of the roll 36 required for generating the second target tension Tb at the medium M located between the intermediate roller pair 41 and the feeding unit 30 by inputting the second target tension Tb to the second tension T2 of the above-described Equation (6).

The second target tension Tb is set to a value with which a state where the medium M located between the intermediate roller pair 41 and the feeding unit 30 is not skewed and broken is maintained. The second target tension Tb is set in accordance with the property of the medium M based on a result of an experiment and/or a simulation performed in advance. The set second target tension Tb is stored in the control unit 50 in association with the property of the medium M. The control unit 50 may select the second target tension Tb based on the input information related to the property of the medium M.

The control unit 50 may repeatedly perform the computation of the second output torque Tq2 described above in a predetermined cycle. The control unit 50 can execute the feed adjustment operation M2 by controlling the feed driving unit 33 such that the computed second output torque Tq2 is generated at the roll 36. In the case where the control unit 50 computes the roll load N2 based on the output of the first encoder 35*a*, it can be said that the control unit 50 executes the feed adjustment operation M2 based on the output of the first encoder 35*a*. In the case where the control unit 50 computes the roll load N2 based on the output of the second encoder 35*b*, it can be said that the control unit 50 executes the feed adjustment operation M2 based on the output of the second encoder 35*b*.

First Period

The control unit 50 executes the feed adjustment operation M2 based on the output of the second encoder 35*b* in a first period P1. The first period P1 is a period from the start of the rotation of the conveyance roller pair 21 until a specified time Tp elapses.

At the time when the specified time Tp elapses after the start of the rotation of the conveyance roller pair 21, the rotational speed of the conveyance roller pair 21 may be being accelerated. The specified time Tp in this case is a period from the timing when the rotation of the conveyance roller pair 21 is started, to the timing when the rotational speed of the conveyance roller pair 21 is being accelerated before the rotational speed of the conveyance roller pair 21 becomes a constant speed. At the time when the specified time Tp elapses after the start of the rotation of the conveyance roller pair 21, the rotational speed of the conveyance roller pair 21 may be a constant speed. The specified time Tp in this case is a period from the timing when the rotation of the conveyance roller pair 21 is started, to the timing when the rotational speed of the conveyance roller pair 21 becomes a constant speed. The specified time Tp may be a set value set in advance through an experiment and the like.

Second Period

The control unit 50 executes the feed adjustment operation M2 based on the output of the first encoder 35*a* in a second period P2 after the completion of the first period P1. The second period P2 is a period from the timing when the specified time Tp elapses after the start of the rotation of the conveyance roller pair 21, to the timing when the conveyance of the medium M by the conveyance unit 12 is stopped. The second period P2 is a period continuous from the first period P1. The control unit 50 performs any of the feed adjustment operation M2 based on the output of the second encoder 35*b* and the feed adjustment operation M2 based on the output of the first encoder 35*a* during the conveyance of the medium M by the conveyance unit 12.

Conveyance Control Method of Medium

Next, an example of a conveyance control method of conveying the medium M by the conveyance unit 12 is described with reference to the flowchart illustrated in FIG. 4. The routine illustrated in FIG. 4 is repeatedly executed in a predetermined cycle on condition that the power of the printing apparatus 10 is turned on.

Figure 4:
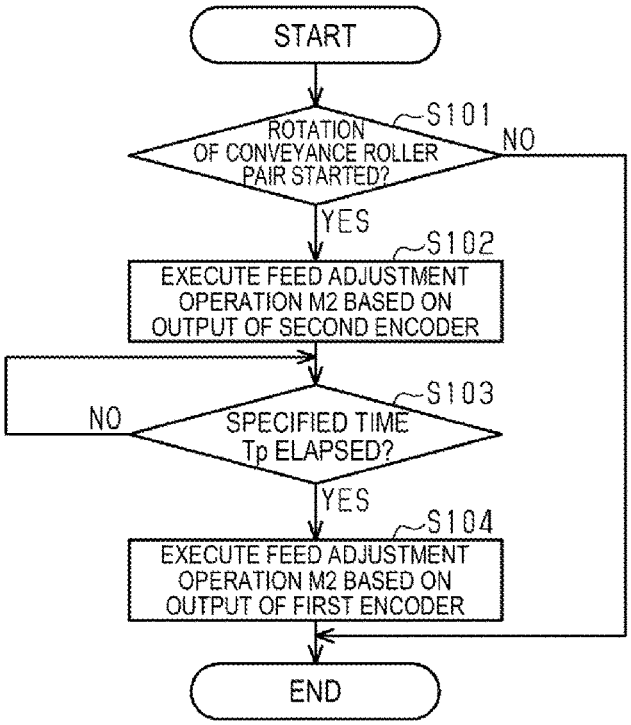
FIG. 4 is a flowchart illustrating a routine performed by a control unit.

As illustrated in FIG. 4, at step S101, the control unit 50 determines whether the rotation of the conveyance roller pair 21 is started. The state where the rotation of the conveyance roller pair 21 is started is a state where the rotation of the conveyance roller pair 21 is accelerated in the state where the rotation of the conveyance roller pair 21 is stopped. When the control unit 50 determines that the rotation of the conveyance roller pair 21 is not started, step S101 is NO. The control unit 50 terminates this routine. When the control unit 50 determines that the rotation of the conveyance roller pair 21 is started, step S101 is YES. The control unit 50 advances the process to step S102.

At step S102, the control unit 50 executes the feed adjustment operation M2 based on the output of the second encoder 35*b*. Here, the control unit 50 executes the feed adjustment operation M2 based on the feeding rotational speed SP2. The control unit 50 advances the process to step S103.

At step S103, the control unit 50 determines whether the specified time Tp has elapsed. At step S103, the control unit 50 determines whether the specified time Tp has elapsed after it is determined at step S101 that the rotation of the conveyance roller pair 21 is started. When the control unit 50 determines that the specified time Tp has not elapsed, step S103 is NO. The control unit 50 makes the determination of step S103 again. The control unit 50 repeatedly executes the process of step S103 until it is determined at step S103 that the specified time Tp has elapsed. When the control unit 50 determines that the specified time Tp has elapsed, step S103 is YES. The control unit 50 advances the process to step S104.

At step S104, the control unit 50 executes the feed adjustment operation M2 based on the output of the first encoder 35*a*. Here, the control unit 50 executes the feed adjustment operation M2 based on the driving rotational speed SP1. After performing the process of step S104, the control unit 50 terminates this routine.

Operations

Operations this embodiment are described below.

The rotation of the roll 36 is transmitted to the feeding unit 30, and then transmitted to the feed driving unit 33. As a result, at the start of the conveyance of the medium M, the difference in rotational speed between the feeding unit 30 and the roll 36 is smaller than the difference in rotational speed between the feed driving unit 33 and the roll 36. Specifically, the difference between the rotational speed of the roll 36 and the feeding rotational speed SP2 detected by the second encoder 35*b* is smaller than the difference between the rotational speed of the roll 36 and the driving rotational speed SP1 detected by the first encoder 35*a*.

At step S101, step S102, and at step S103, the control unit 50 executes the feed adjustment operation M2 based on the output of the second encoder 35*b* in the first period P1 from the start of the rotation of the conveyance roller pair 21 until the specified time Tp elapses. Thus, in the state where the difference in rotational speed between the feed driving unit 33 and the roll 36 is large, the control unit 50 can execute the feed adjustment operation M2 based on the rotational speed of the feeding unit 30 with a small difference in rotational speed from the roll 36.

In the second period P2 after the completion of the first period P1, the difference in rotational speed between the feed driving unit 33 and the roll 36 is smaller than in the first period P1 from the start of the rotation of the conveyance roller pair 21 until the specified time Tp elapses. At step S104, in the second period P2 after the completion of the first period P1, the control unit 50 executes the feed adjustment operation M2 based on the output of the first encoder 35*a*. Thus, in the state where the difference in rotational speed between the feed driving unit 33 and the roll 36 is small, the control unit 50 can execute the feed adjustment operation M2 based on the rotational speed of the feed driving unit 33.

Effects

Effects of this embodiment are described below.

(1) The rotation of the roll 36 is transmitted to the feeding unit 30, and then transmitted to the feed driving unit 33. As a result, at the start of the conveyance of the medium M, the difference in rotational speed between the feeding unit 30 and the roll 36 is smaller than the difference in rotational speed between the feed driving unit 33 and the roll 36. The control unit 50 executes the feed adjustment operation M2 based on the output of the second encoder 35*b* in the first period P1 from the start of the rotation of the conveyance roller pair 21 until the specified time Tp elapses. The second encoder 35*b* detects the rotational speed of the feeding unit 30. Thus, in the state where the difference in rotational speed between the feed driving unit 33 and the roll 36 is large, the control unit 50 can execute the feed adjustment operation M2 based on the rotational speed of the feeding unit 30 with a small difference in rotational speed from the roll 36. Thus, the accuracy of the feed adjustment operation M2 can be improved.

(2) The feeding unit 30 includes the supporting unit 31 that supports the roll 36, and the power transmission mechanism 34 that transmits the rotary power of the feed driving unit 33 to the supporting unit 31. In this case, the difference in rotational speed between the feed driving unit 33 and the roll 36 at the start of the conveyance of the medium M is greater than in the case where the feed driving unit 33 and the supporting unit 31 are directly coupled to each other and the feed driving unit 33 drives the supporting unit 31 into rotation. As such, if the control unit 50 executes the feed adjustment operation M2 based on the output of the first encoder 35*a* when the rotation of the conveyance roller pair 21 is started, there is a risk of further reduction of the accuracy of the feed adjustment operation M2. The control unit 50 executes the feed adjustment operation M2 based on the output of the second encoder 35*b* when the rotation of the conveyance roller pair 21 is started. In this manner, the accuracy of the feed adjustment operation M2 can be improved even in the case where there is a risk of further reduction of the accuracy of the feed adjustment operation M2 as described above.

(3) The intermediate driving unit 43 rotates the intermediate roller pair 41. By controlling the intermediate driving unit 43, the control unit 50 can execute the intermediate adjustment operation M1 that adjusts the tension T of the medium M located between the conveyance roller pair 21 and the intermediate roller pair 41. Thus, conveyance errors caused in the medium M located between the conveyance roller pair 21 and the intermediate roller pair 41 during conveyance of the medium M can be eliminated through the intermediate adjustment operation M1.

(4) In the second period P2 after the completion of the first period P1, the difference in rotational speed between the feed driving unit 33 and the roll 36 is smaller than in the first period P1 from the start of the rotation of the conveyance roller pair 21 until the specified time Tp elapses. The control unit 50 executes the feed adjustment operation M2 based on the output of the first encoder 35*a* in the second period P2 after the completion of the first period P1. The first encoder 35*a* detects the rotational speed of the feed driving unit 33. Thus, in the state where the difference in rotational speed between the feed driving unit 33 and the roll 36 is small, the control unit 50 can execute the feed adjustment operation M2 based on the rotational speed of the feed driving unit 33. The feed driving unit 33 can be controlled for the feed adjustment operation M2 based on the rotational speed of the feed driving unit 33 in the state where there is no risk of reduction in accuracy of the feed adjustment operation M2 even when the feed adjustment operation M2 is executed based on the rotational speed of the feed driving unit 33. Thus, the feed adjustment operation M2 can be stabilized.

Modifications

The above-described embodiment may be modified as follows for implementation. The above-described embodiment and the following modifications may be combined for implementation insofar as they are not technically inconsistent.

The roll 36 may be supported by a spindle inserted in the roll 36. The supporting unit 31 in this case includes the spindle. The spindle has a shaft-like shape extending in the width direction X. A spindle gear may be provided at one of both end portions of the spindle. The spindle gear may be one gear making up the power transmission mechanism 34. In this case, the power transmission mechanism 34 transmits the rotary power of the feed driving unit 33 to the spindle of the supporting unit 31. In this manner, the feed driving unit 33 drives the feeding unit 30 including the spindle into rotation.

The second encoder 35*b* may detect the rotational speed of the supporting unit 31. In this case, in the first period P1 from the start of the rotation of the conveyance roller pair 21 until the specified time Tp elapses, the feed adjustment operation M2 is executed based on the rotational speed of the supporting unit 31. Note that in the case where the supporting unit 31 includes the holder 31*a*, the second encoder 35*b* may detect the rotational speed of the holder 31*a*. In the case where the supporting unit 31 includes the spindle, the second encoder 35*b* may detect the rotational speed of the spindle.

The conveyance transmission mechanism 24 may be omitted from the first driving unit 22. In this case, the conveyance driving unit 23 may be directly coupled to the first driving roller 21*a*.

The intermediate transmission mechanism 44 may be omitted from the second driving unit 42. In this case, the intermediate driving unit 43 may be directly coupled to the second driving roller 41*a*.

The intermediate roller pair 41 and the intermediate driving unit 43 may be omitted from the conveyance unit 12. In this case, the control unit 50 omits the execution of the intermediate adjustment operation M1. In the feed adjustment operation M2, the control unit 50 adjusts the tension T of the medium M fed from the feeding unit 30.

The power transmission mechanism 34 may be omitted from the feeding unit 30. In this case, the feed driving unit 33 may be directly coupled to the supporting unit 31.

The printing apparatus 10 may be a liquid discharging apparatus that jets and ejects liquid other than ink. Examples of the state of the liquid ejected in the form of a very small amount of droplets from the liquid discharging apparatus include granular shapes, teardrop shapes, and thread-like tail shapes. Here, the liquid need only be a material that can be ejected from the liquid discharging apparatus. For example, the liquid need only be a material in a liquid phase, and includes liquid materials with high or low viscosity, and fluid materials such as sols, gel waters, other inorganic solvents, organic solvents, solutions, liquid resins, liquid metals, and metal liquid solutions. The liquid includes not only liquid as a state of a material, but also particles of functional materials composed of solids, such as pigments and metal particles, dissolved, dispersed or mixed in a solvent. Typical examples of the liquid include the ink, liquid crystal and the like as described in the embodiments. Here, the ink encompasses various liquid compositions such as common water-based inks, oil inks, gel inks, and hot melt inks. Specific examples of liquid discharging apparatus include apparatuses that eject liquid containing materials, such as electrode materials and color materials in a dispersed or dissolved state, used for manufacturing and the like of liquid crystal displays, electroluminescence displays, surface-emission displays, and color filters, for example. The liquid discharging apparatus may be an apparatus that ejects biological organic materials used for manufacturing biochips, an apparatus that is used as a precision pipette and ejects liquid as a sample, a textile printing apparatus, a micro dispenser, and the like. The liquid discharging apparatus may be an apparatus that exactly ejects lubricating oil to precision machines such as clocks and cameras, and an apparatus that ejects transparent resin liquid such as ultraviolet curable resin onto a substrate for the purpose of forming optical lenses and minute hemisphere lenses used for optical communication elements and the like. The liquid discharging apparatus may be an apparatus that ejects acid or alkali etchant for the purpose of etching a substrate and the like.

SUPPLEMENTARY NOTES

Technical ideas and operational effects thereof derived from the above-described embodiments and modifications are described below.

(A) A printing apparatus includes a conveyance unit configured to convey a medium, a printing unit configured to perform printing on the medium conveyed by the conveyance unit, and a control unit configured to control the conveyance unit. The conveyance unit includes a feeding unit configured to feed the medium from a roll wound with the medium in a rolled form, a conveyance roller pair configured to convey, toward the printing unit, the medium fed by the feeding unit while sandwiching the medium, a feed driving unit configured to drive the feeding unit into rotation, a first encoder configured to detect a rotational speed of the feed driving unit, and a second encoder configured to detect a rotational speed of the feeding unit. The control unit is configured to execute a feed adjustment operation of adjusting tension of the medium fed from the feeding unit by controlling the feed driving unit such that the control unit executes the feed adjustment operation based on an output of the second encoder in a first period from a start of rotation of the conveyance roller pair until a specified time elapses and such that the control unit executes the feed adjustment operation based on an output of the first encoder in a second period after completion of the first period.

With this configuration, the rotation of the roll is transmitted to the feeding unit, and then transmitted to the feed driving unit. Thus, at the start of the conveyance of the medium, the difference in rotational speed between the feeding unit and the roll is smaller than the difference in rotational speed between the feed driving unit and the roll. The control unit executes the feed adjustment operation based on the output of the second encoder in the first period from the start of the rotation of the conveyance roller pair until the specified time elapses. The second encoder detects the rotational speed of the feeding unit. Thus, in the state where the difference in rotational speed between the feed driving unit and the roll is large, the control unit can execute the feed adjustment operation based on the rotational speed of the feeding unit with a small difference in rotational speed from the roll. Thus, the accuracy of the feed adjustment operation can be improved.

(B) In the printing apparatus, the feeding unit includes a supporting unit configured to support the roll, and a power transmission mechanism configured to transmit a rotary power of the feed driving unit to the supporting unit.

With this configuration, the feeding unit includes the supporting unit that supports the roll, and the power transmission mechanism that transmits the rotary power of the feed driving unit to the supporting unit. In this case, the difference in rotational speed between the feed driving unit and the roll at the start of the conveyance of the medium is greater than in the case where the feed driving unit and the supporting unit are directly coupled to each other and the feed driving unit drives the supporting unit into rotation. As such, if the control unit executes the feed adjustment operation based on the output of the first encoder when the rotation of the conveyance roller pair is started, there is a risk of further reduction of the accuracy of the feed adjustment operation. The control unit executes the feed adjustment operation based on the output of the second encoder when the rotation of the conveyance roller pair is started, and thus the accuracy of the feed adjustment operation can be improved even in the case where there is a risk of further reduction of the accuracy of the feed adjustment operation as described above.

(C) In the printing apparatus, the second encoder detects a rotational speed of the power transmission mechanism.

(D) In the printing apparatus, the feeding unit includes a supporting unit configured to support the roll, the feed driving unit drives the supporting unit into rotation, and the second encoder detects a rotational speed of the supporting unit.

(E) In the printing apparatus, the conveyance unit includes an intermediate roller pair configured to convey, toward the conveyance roller pair, the medium fed by the feeding unit while sandwiching the medium at a position between the feeding unit and the conveyance roller pair, and an intermediate driving unit configured to rotate the intermediate roller pair. The control unit is configured to execute the feed adjustment operation by adjusting tension of the medium located between the intermediate roller pair and the feeding unit, and the control unit is configured to execute an intermediate adjustment operation of adjusting tension of the medium located between the conveyance roller pair and the intermediate roller pair by controlling the intermediate driving unit.

With this configuration, the intermediate driving unit rotates the intermediate roller pair. The control unit can execute the intermediate adjustment operation that adjusts the tension of the medium located between the conveyance roller pair and the intermediate roller pair by controlling the intermediate driving unit. Thus, conveyance errors caused in the medium located between the conveyance roller pair and the intermediate roller pair during the conveyance of the medium can be eliminated through the intermediate adjustment operation.

(F) In a conveyance control method of conveying a medium by a conveyance unit, the conveyance unit including a feeding unit configured to feed the medium from a roll wound with the medium in a rolled form, a conveyance roller pair configured to convey the medium fed by the feeding unit while sandwiching the medium, a feed driving unit configured to drive the feeding unit into rotation, a first encoder configured to detect a rotational speed of the feed driving unit, and a second encoder configured to detect a rotational speed of the feeding unit, the conveyance control method includes executing a feed adjustment operation of adjusting tension of the medium fed from the feeding unit by controlling the feed driving unit such that the feed adjustment operation is executed based on an output of the second encoder in a first period from a start of rotation of the conveyance roller pair until a specified time elapses and such that the feed adjustment operation is executed based on an output of the first encoder in a second period after completion of the first period.

With this method, the rotation of the roll is transmitted to the feeding unit, and then transmitted to the feed driving unit. Thus, at the start of the conveyance of the medium, the difference in rotational speed between the feeding unit and the roll is smaller than the difference in rotational speed between the feed driving unit and the roll. The feed adjustment operation is executed based on the output of the second encoder in the first period from the start of the rotation of the conveyance roller pair until the specified time elapses. The second encoder detects the rotational speed of the feeding unit. The feed adjustment operation is executed based on the output of the second encoder in the first period from the start of the rotation of the conveyance roller pair until the specified time elapses. Thus, the accuracy of the feed adjustment operation can be improved.

What is claimed is:

1. A printing apparatus comprising:

a conveyance unit configured to convey a medium;

a printing unit configured to perform printing on the medium conveyed by the conveyance unit; and a control unit configured to control the conveyance unit, wherein the conveyance unit includes:

a feeding unit configured to feed the medium from a roll wound with the medium in a rolled form, a conveyance roller pair configured to convey, toward the printing unit, the medium fed by the feeding unit while sandwiching the medium, a feed driving unit configured to drive the feeding unit into rotation, a first encoder configured to detect a rotational speed of the feed driving unit, and a second encoder configured to detect a rotational speed of the feeding unit and the control unit is configured to execute a feed adjustment operation of adjusting tension of the medium fed from the feeding unit by controlling the feed driving unit such that the control unit executes the feed adjustment operation based on an output of the second encoder in a first period from a start of rotation of the conveyance roller pair until a specified time elapses and such that the control unit executes the feed adjustment operation based on an output of the first encoder in a second period after completion of the first period.

2. The printing apparatus according to claim 1, wherein the feeding unit includes:

a supporting unit configured to support the roll and a power transmission mechanism configured to transmit a rotary power of the feed driving unit to the supporting unit.

3. The printing apparatus according to claim 2, wherein the second encoder detects a rotational speed of the power transmission mechanism.

4. The printing apparatus according to claim 1, wherein the feeding unit includes a supporting unit configured to support the roll, the feed driving unit drives the supporting unit into rotation, and the second encoder detects a rotational speed of the supporting unit.

5. The printing apparatus according to claim 1, wherein the conveyance unit includes:

an intermediate roller pair configured to convey, toward the conveyance roller pair, the medium fed by the feeding unit while sandwiching the medium at a position between the feeding unit and the conveyance roller pair and an intermediate driving unit configured to rotate the intermediate roller pair, the control unit is configured to execute the feed adjustment operation by adjusting tension of the medium located between the intermediate roller pair and the feeding unit, and the control unit is configured to execute an intermediate adjustment operation of adjusting tension of the medium located between the conveyance roller pair and the intermediate roller pair by controlling the intermediate driving unit.

6. A conveyance control method of conveying a medium by a conveyance unit, the conveyance unit including:

a feeding unit configured to feed the medium from a roll wound with the medium in a rolled form, a conveyance roller pair configured to convey the medium fed by the feeding unit while sandwiching the medium, a feed driving unit configured to drive the feeding unit into rotation, a first encoder configured to detect a rotational speed of the feed driving unit, and a second encoder configured to detect a rotational speed of the feeding unit, the conveyance control method comprising:

executing a feed adjustment operation of adjusting tension of the medium fed from the feeding unit by controlling the feed driving unit such that the feed adjustment operation is executed based on an output of the second encoder in a first period from a start of rotation of the conveyance roller pair until a specified time elapses and such that the feed adjustment operation is executed based on an output of the first encoder in a second period after completion of the first period.

* * * * *